US009555416B2

(12) United States Patent
Yoshikawa et al.

(10) Patent No.: US 9,555,416 B2
(45) Date of Patent: Jan. 31, 2017

(54) JET MILL

(75) Inventors: Masahiro Yoshikawa, Yawata (JP); Tomoyuki Chiba, Hirakata (JP); Takashi Shibata, Kyoto (JP)

(73) Assignee: HOSOKAWA MICRON CORPORATION, Hirakata-shi, Osaka (JP)

( * ) Notice: Subject to any disclaimer, the term of this patent is extended or adjusted under 35 U.S.C. 154(b) by 560 days.

(21) Appl. No.: 13/812,638

(22) PCT Filed: Jul. 28, 2011

(86) PCT No.: PCT/JP2011/067289

§ 371 (c)(1),
(2), (4) Date: Apr. 5, 2013

(87) PCT Pub. No.: WO2012/014985

PCT Pub. Date: Feb. 2, 2012

(65) Prior Publication Data

US 2013/0186993 A1 Jul. 25, 2013

(30) Foreign Application Priority Data

Jul. 30, 2010 (JP) ..... 2010-171514

(51) Int. Cl.
*B02C 19/06* (2006.01)
*B02C 23/12* (2006.01)
(Continued)

(52) U.S. Cl.
CPC ..... *B02C 19/06* (2013.01); *B02C 19/066* (2013.01); *B02C 19/068* (2013.01); *B02C 23/12* (2013.01); *B07B 7/083* (2013.01); *B07B 7/086* (2013.01)

(58) Field of Classification Search
CPC ..... B02C 19/06; B02C 19/066; B02C 19/068; B02C 19/061
(Continued)

(56) References Cited

U.S. PATENT DOCUMENTS 4,451,005 A 5/1984 Urayama
4,538,764 A * 9/1985 Dunbar ..... B02C 19/065 241/39
(Continued)

FOREIGN PATENT DOCUMENTS

JP S28-3945 A 8/1953
JP S57-190656 A 11/1982
(Continued)

OTHER PUBLICATIONS

Int'l Search Report issued Sep. 6, 2011 in Int'l Application No. PCT/JP2011/067289.

*Primary Examiner* — Faye Francis
(74) *Attorney, Agent, or Firm* — Panitch Schwarze Belisario & Nadel LLP

(57) ABSTRACT

Disposed is a jet mill that has a cylindrical pulverization chamber (10) and a classification chamber (6) that connects to the pulverization chamber (10). A fine-powder discharge port (4*a*) and a classification rotor (7) are provided in the classification chamber (6). A feedstock supply port (5) and at least one gas emission nozzle (11) are provided in the pulverization chamber (10). The shape of the classification chamber (6) is a cone that starts on the inner wall of the pulverization chamber (10), and is angled towards the classification rotor (7). This configuration gives the jet mill high efficiency of pulverization and reduces the amount of powders left in the chamber when the jet mill has finished running.

6 Claims, 5 Drawing Sheets

(51) Int. Cl.
*B07B 7/083* (2006.01)
*B07B 7/086* (2006.01)

(58) Field of Classification Search
USPC ..... 241/5, 39, 79.1
See application file for complete search history.

(56) References Cited

U.S. PATENT DOCUMENTS

| | | | | | |
|---|---|---|---|---|---|
| 4,875,629 | A * | 10/1989 | Brors | ..... | 241/39 |
| 5,547,135 | A * | 8/1996 | Moriya | ..... | B02C 19/066 241/40 |
| 7,156,331 | B2 * | 1/2007 | Takahashi | ..... | B02C 19/068 241/39 |
| 7,364,101 | B2 * | 4/2008 | Tanaka | ..... | B02C 19/065 241/39 |
| 7,604,186 | B2 * | 10/2009 | Sawada | ..... | B02C 19/068 241/1 |
| 7,753,296 | B2 * | 7/2010 | Makino | ..... | B01J 2/16 241/38 |
| 2004/0016835 | A1 * | 1/2004 | Casalmir | ..... | B02C 19/068 241/39 |

FOREIGN PATENT DOCUMENTS

| | | | |
|---|---|---|---|
| JP | H04-210252 | A | 7/1992 |
| JP | H09-206620 | A | 8/1997 |
| JP | 2007-275849 | A | 10/2007 |

* cited by examiner

PRIOR ART

JET MILL

CROSS-REFERENCE TO RELATED APPLICATION

This application is a Section 371 of International Application No. PCT/JP2011/067289, filed Jul. 28, 2011, which was published in the Japanese language on Feb. 2, 2012, under International Publication No. WO 2012/014985 A1, and the disclosure of which is incorporated herein by reference.

TECHNICAL FIELD

The present invention relates to a jet mill for finely pulverizing toner, powdered paint, minerals, and the like.

BACKGROUND ART

An example of this type of jet mill is a fluidized bed type jet mill having a cylindrical container 20 capable of storing raw material powder (hereinbelow simply referred to as "powder") as an object to be pulverized, wherein a plurality of gas emission nozzles 21 are provided facing each other toward the center from the external peripheral wall of the container, and the powder is carried on emitted gas from the gas emission nozzles 21 to collide with itself and be pulverized, as shown in FIG. 5. A stable performance can be achieved with a jet mill of this configuration, but because the pulverization is performed with powder becoming stagnant inside the apparatus, a problem with this jet mill is that powder remains in the apparatus even after pulverization has ended.

Another type of jet mill is a jet mill such as those shown in Patent Document 1 and Patent Document 2 listed below, wherein powder is made to swirl together with air by emitted gas from the emission nozzles provided to the peripheral wall of a cylindrical pulverization chamber, the powder is pulverized, and the pulverized powder is sent to a classification chamber above the pulverization chamber where it is classified.

In the jet mill disclosed in Patent Document 1, a plurality of gas emission nozzles are attached in a tilted manner with each other in the external peripheral wall of the pulverization chamber, and the powder is carried by emitted gas from the gas emission nozzles and pulverized while swirling at high speed.

In the jet mill disclosed in Patent Document 2, a collision member is provided at a position facing a gas emission port of a gas emission nozzle across a predetermined gap, and the powder is carried by the emitted gas and pulverized by colliding with the collision member.

In the jet mills of Patent Documents 1 and 2, a classification chamber is provided with a classification rotor disposed in the top part of the pulverization chamber, and powder that has been pulverized into the desired grain size is classified and collected.

PRIOR ART DOCUMENTS

Patent Documents

[Patent Document 1] Japanese Laid-open Patent Application No. 9-206620

[Patent Document 2] Japanese Laid-open Patent Application No. 4-210252

DISCLOSURE OF THE INVENTION

Problems that the Invention is Intended to Solve

In the jet mill of Patent Document 1, the pulverization chamber and the classification chamber are sectioned off by a ring-shaped member, creating a partitioned state. Although this has the effect of preventing the pulverization chamber and the classification chamber from adversely affecting each other, while powder which has been pulverized in the pulverization chamber should be sent to the classification chamber, powder that is not pulverized to at least a certain extent remains in the pulverization chamber. On the other hand, in the classification chamber, while powder that has been pulverized to a predetermined grain size or smaller is expelled out of the apparatus and collected, some powder that has not been pulverized to a predetermined grain size or smaller is returned to the pulverization chamber, most powder stagnates in the classification chamber. As a result, pressure loss in the classification chamber increases as does the powder concentration in the classification chamber, whereby there is a risk that proper classification will not be performed.

Although the jet mill of Patent Document 2 has the addition of the collision member, the structures of the pulverization chamber and the classification chamber are substantially the same as those of Patent Document 1. However, there is no sectioning off of the pulverization chamber and the classification chamber, and the powder can move freely from the pulverization chamber to the classification chamber or from the classification chamber to the pulverization chamber. On the other hand, powder with an intermediate grain size that has not been pulverized to a predetermined grain size or smaller stagnates easily in the peripheral wall of the classification chamber or near the center of the pulverization chamber where the effect of the swirling air flow is comparatively small.

In these jet mills, there is a risk that proper operation cannot continue if the amount of stagnant powder in the apparatus increases, since the pulverization chamber and the classification chamber are made compact.

In view of the problems described above, an object of the present invention is to provide a jet mill which, although being compact, has high pulverization efficiency and has little stagnation of powder in the apparatus even during operation.

Means for Solving the Problems

A jet mill according to a first aspect of the present invention has a cylindrical pulverization chamber and a classification chamber connected with the pulverization chamber, wherein the classification chamber is provided with a classification rotor connected with a fine-powder discharge port, the pulverization chamber is provided with a raw material supply port and at least one gas emission nozzle disposed slanted in the rotational direction of the classification rotor from the external peripheral wall surface, and the classification chamber has a conical shape that has its starting point on the internal peripheral wall surface of the pulverization chamber, and inclined toward the classification rotor along the axis of the classification rotor.

Thus, by forming the pulverization chamber as a cylinder and forming the classification chamber connected with the pulverization chamber as a conical shape, powder pulverized in the pulverization chamber swirls along the internal peripheral surface of the pulverization chamber and also swirls along the internal peripheral surface of the classification chamber due to the flow of emitted gas from the gas emission nozzle. At this time, powder with a large grain size has a higher swirling speed and therefore swirls through an area near the outer sides of the pulverization chamber and classification chamber. This is a pulverization area and the powder is continuously subjected to the pulverizing action. On the other hand, powder with a small grain size has a lower swirling speed and therefore travels along the internal peripheral surface of the classification chamber on the inner side and reaches the classification area of the classification chamber. Specifically, in the classification chamber with a conical internal peripheral surface inclined so as to be decreased in diameter the more distant from the pulverization chamber, powder grains with higher swirling speed swirl through a greater swirling circumference. On the other hand, powder grains with a lower swirling speed are carried by upward conveying air that flows into the classification rotor, and swirl through a smaller swirling circumference.

Thus, the powder moves to a classification area distant from the pulverization chamber, and the powder is subject to the classifying action of the classification rotor. As the result, unnecessary movement of the powder from the pulverization chamber to the classification chamber being suppressed, powder to be pulverized can be retained in the pulverization chamber, and pulverized powder are quickly sent to the classification chamber and classified. Thus, in the classification chamber, fine powder is led to the classification rotor and passed through the classification rotor to be expelled out of the apparatus. On the other hand, powder with an intermediate grain size, once having entered into the classification chamber, is led by the classification rotor and returned to the pulverization chamber by rebounding action of classification rotors. In the pulverization chamber, due to the gas emitted from the gas emission nozzle, the powder can be efficiently pulverized by collisions with the internal peripheral wall surface of the pulverization chamber and by collisions with itself in the pulverization area. And, since the amount of powder currently pulverized in the classification chamber (equivalent to coarse powder of a comparatively large grain size among the powder) can be reduced, the load on the classification rotor is reduced, and coarse powder can be suppressed from getting into the product.

According to another aspect of the present invention, a circular truncated cone shaped adapter is provided to the center part of the classification chamber, the adapter being inclined from a bottom surface part of the classification chamber toward a base end side of the classification rotor inwardly along the axis.

By providing the circular truncated cone shaped adapter to the center part of the pulverization chamber, it becomes possible for coarse powder from the classification chamber to be effectively led toward the internal peripheral wall surface of the pulverization chamber. Providing the circular truncated cone shaped adapter to the center part of the pulverization chamber also makes it possible to reduce unnecessary space in the pulverization chamber. Specifically, when there is no circular truncated cone shaped adapter, the volume of space in the pulverization chamber becomes greater, and an area where the swirl flow speed is low will be formed in the center part of the pulverization chamber. Coarse powder not classified in the classification chamber or powder of intermediate grain size may stagnate in this area. However, providing a conical pedestal eliminates the space in the center part of the pulverization chamber, and powder can be directed toward the internal peripheral surface of the pulverization chamber where the swirling speed is high. Thereby, powder does not stagnate in the center part, powder currently being pulverized can also be effectively led to the pulverization area, and as a result, pulverization efficiency can be improved.

In the present specification, the term "pulverization efficiency" refers to the processing capability of the jet mill per unit of air quantity. The unit air quantity is the volume of air per unit time emitted from the gas emission nozzle. When a plurality of gas emission nozzles are provided, the unit air quantity is the total value of air volume per unit time emitted from all of the gas emission nozzles. For example, a jet mill with high pulverization efficiency is jet mill that has a high processing capability even with the same air quantity, and the present invention, which is capable of yielding high pulverization efficiency, is also advantageous in view of energy conservation.

According to another aspect of the present invention, a collision member is provided facing the distal end of the gas emission nozzle across a predetermined gap.

Providing a collision member at a predetermined gap from the distal end of the gas emission nozzle makes it possible to impart a strong collision force to the powder because the powder will reliably collide with the collision member. That is to say, the collision force the powder undergoes from the collision member is greater than that of when the powder colliding with itself. Particularly, the smaller the grain size of the powder, the less the collision force and the chance of powder to collide with itself. Therefore, it was difficult to impart sufficient collision force to the powder. On the other hand, in the present configuration, by providing a collision member, collision force can be reliably imparted to the powder, and fine pulverization can effectively take place. As a result, pulverization efficiency improves and the stagnant amount in the apparatus decreases. And, since the collision member is provided in the pulverization area through which the powder swirls, the swirling powder being also subjected to collision and pulverization, pulverization efficiency improves and the amount of stagnant powder in the apparatus decreases.

According to another aspect of the present invention, a collision surface of the collision member is inclined relative to the gas emission nozzle toward the internal peripheral surface of a casing of the pulverization chamber.

Due to the collision surface of the collision member being inclined relative to the gas emission nozzle toward the internal peripheral surface side of a casing of the pulverization chamber, most of the powder collided with the collision surface rebounds toward the internal peripheral surface of the casing of the pulverization chamber along the angle of collision with the inclined surface, and collides with the internal peripheral surface of the casing. The powder is further pulverized by this collision.

Another characteristic configuration of the present invention is that the collision member is configured as a cone, a pyramid, or an obliquely truncated circular or polygonal pillar.

By forming the collision member as a cone, a pyramid, or an obliquely truncated circular or polygonal pillar, it becomes possible to control the rebounding direction or progressing direction of the powder after it has collided with the collision member, in accordance with the type of powder or the desired grain size.

Another characteristic configuration of the present invention is that the pulverization chamber and the classification chamber are integrated together and oriented laterally.

By configuring the pulverization chamber and the classification chamber integrated together and oriented laterally, gravity can be utilized in the pulverization chamber to collect powder in the pulverization area positioned in the bottom of the pulverization chamber, and the incidence of the powder colliding with itself or of the powder colliding with the collision member in said area can therefore be reliably increased. It is thereby possible to further improve the pulverization efficiency.

Another characteristic configuration of the present invention is that the gas emission nozzle is oriented substantially horizontally at a position at the bottom of the pulverization chamber.

By configuring the gas emission nozzle oriented substantially horizontally in the pulverization area at the bottom of the pulverization chamber where powder is collected, acceleration force can be more reliably imparted to the powder, and the powder can be pulverized effectively.

BEST MODE FOR EMBODYING THE INVENTION

First Embodiment

Figure 1:
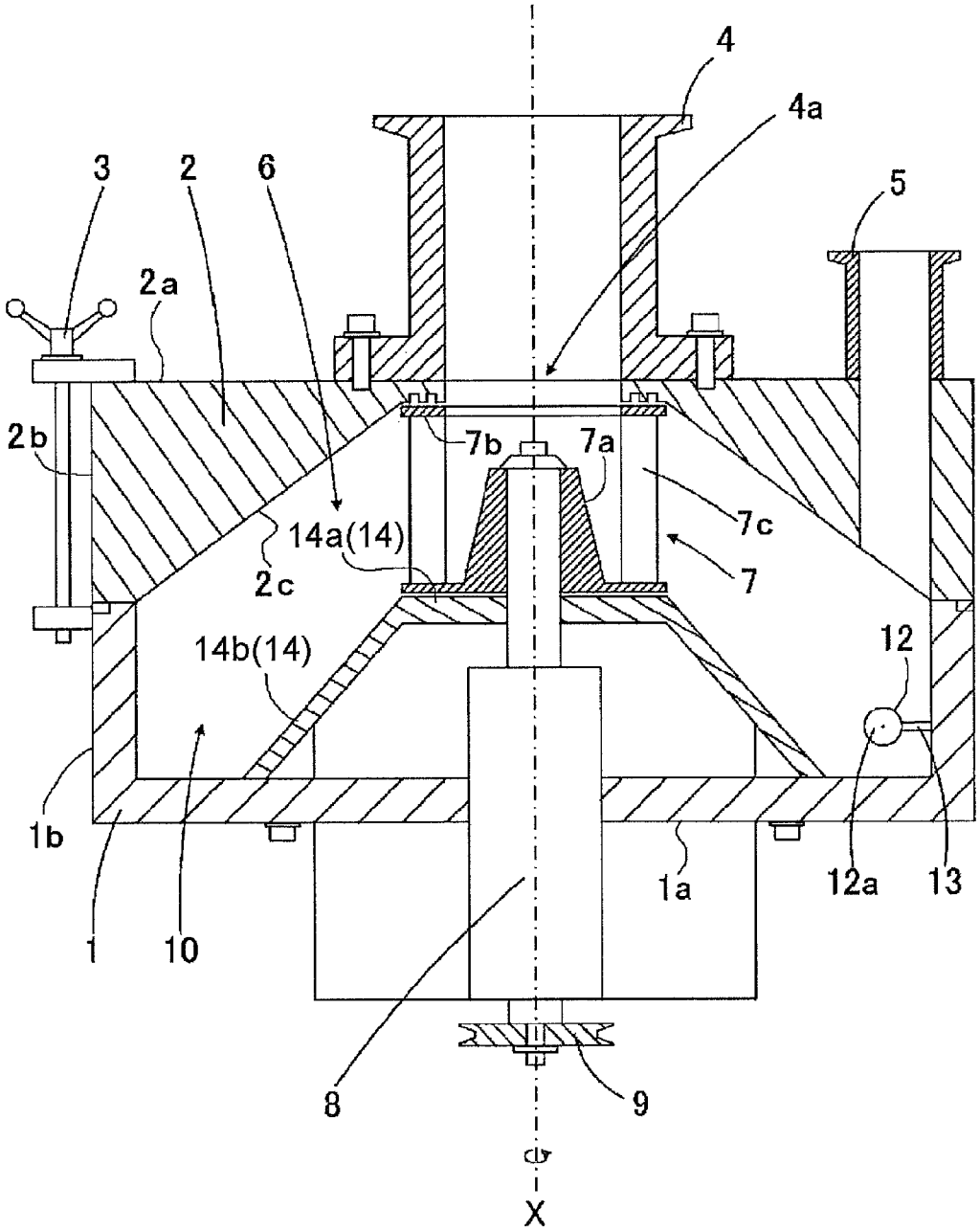
FIG. 1 is a cross-sectional view showing an embodiment of the jet mill of the present invention.

The first embodiment of the present invention will be described hereunder based on FIGS. 1 and 2.

The jet mill according to the first embodiment of the present invention has a bottomed cylindrical lower casing 1 open at the top, and an upper casing 2 superposed on the lower casing 1. The upper casing 2 is removably attached to the lower casing 1 by a fastening tool 3. With the upper casing 2 attached to the lower casing 1, the upper casing 2 and the lower casing 1 have a common vertical axis X, as shown in FIG. 1. In FIG. 2, the upper casing 2 is shown as being removed.

The lower casing 1 has a generally cup-like shape comprising a generally cylindrical bottom portion 1*a* having a through-hole in the center, and a cylindrical side wall portion 1*b* generally extending vertically upward from the radially outer side end of the bottom portion 1*a*.

The upper casing 2 has a generally annular shape comprising a fine-powder discharge port 4*a* in the center the fine-powder discharge port 4*a* being for discharging fine powder. More specifically, the upper casing 2 has a top surface 2*a* extending generally horizontally, a cylindrical external peripheral surface 2*b* extending generally vertically downward from the radially outer side end of the top surface 2*a*, and a generally conical inner peripheral surface 2*c* extending obliquely upwards in a substantially linear manner from the bottom end of the external peripheral surface 2*b* to the radially inner side end of the top surface 2*a*, i.e. to the fine-powder discharge port 4*a*.

A fine-powder discharge tube 4 is connected to the top of the fine-powder discharge port 4*a* so as to share an axis X. In a location near the external periphery of the upper casing 2, a raw material supply tube 5 (an example of the raw material supply port) passing vertically through the upper casing 2 is provided, and powder as a material to be processed is supplied to the lower casing 1 via this raw material supply tube 5.

Attached to the center of the bottom portion 1*a* in the lower casing 1 is a bottom plate 14 in the shape of a circular truncated cone (an example of the circular truncated cone-shaped adapter), comprising a top surface 14*a* having a flat circular outer shape slightly larger than the fine-powder discharge port 4*a*, and an inclined side surface 14*b* expanding gradually outward from the external periphery of the top surface 14*a* toward the bottom portion 1*a*.

Since the outside diameter, i.e. the maximum outside diameter of the lower end of the bottom plate 14 is designed to be sufficiently smaller than the inside diameter of the side wall portion 1*b* of the lower casing 1, part of the bottom portion 1*a* (the outermost periphery) of the lower casing 1 extends as a generally flat annular portion between the external periphery of the bottom plate 14 and the internal periphery of the side wall portion 1*b* of the lower casing 1.

A generally circular truncated cone-shaped space is formed within the jet mill by the conical inner peripheral surface 2*c* of the upper casing 2 and the inclined side surface 14*b* of the bottom plate 14, and this circular truncated cone-shaped space is conveniently divided into a lower pulverization chamber 10 where mainly pulverization takes place, and an upper classification chamber 6 where mainly classification takes place.

Figure 2:
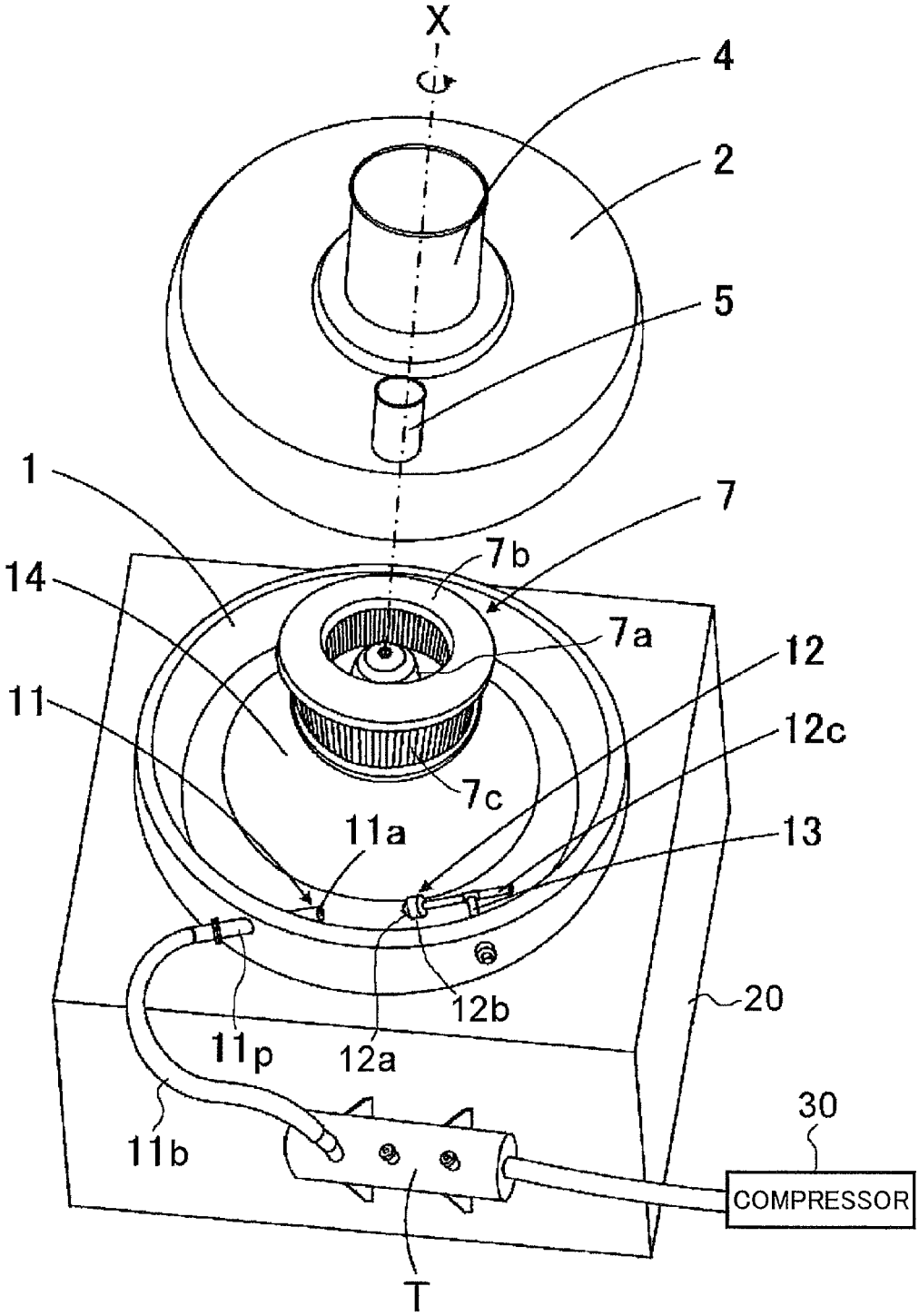
FIG. 2 is a perspective view showing an embodiment of the jet mill of the present invention.

A gas emission nozzle 11 is provided in the pulverization chamber 10 as shown in FIG. 2. The gas emission nozzle 11 is provided at the distal end of a gas jet tube 11*p* attached so as to pass through the side wall portion 1*b* of the lower casing 1, and the gas emission nozzle 11 is provided to be inclined in the rotational direction of a classification rotor 7, described hereinafter, from the external peripheral side surface of the side wall portion 1*b*. The proximal end side of the gas jet tube 11*p* is connected with a compressor 30 by a gas supply hose 11*b*. A gas storage tank T is provided in the middle of the gas supply hose 11*b*, the gas storage tank T being fixed to a casing 20 that supports the jet mill.

Since the gas jet tube 11*p* and the gas emission nozzle 11 are disposed inclined laterally in relation to the diameter of the lower casing 1, high-pressure compressed gas from the compressor 30 discharged from the gas emission nozzle 11 generates a high-speed swirl flow of gas in the pulverization chamber 10. The angle of inclination in relation to the diameter of the gas jet tube lip and the gas emission nozzle 11 is preferably set within a range of approximately 40 to 70 degrees when the inside diameter of the lower casing 1 is approximately 400 mm, for example, but the angle of inclination can be an angle needed to generate a swirl flow in the pulverization chamber 10.

Furthermore, a collision member 12 as pulverizing means is provided in the pulverization chamber 10. The collision member 12 is disposed at a position inwardly separated by a predetermined distance from the side wall portion 1*b* and bottom portion 1*a* of the lower casing 1, and the collision member 12 has a columnar base part 12*b* and a conical collision surface 12*a* provided to the base part 12*b* on the opposite side of a rod-shaped member 12*c*.

As shown in FIG. 2, the collision member 12 is disposed at an end of the rod-shaped member 12*c* provided as parallel with the gas jet tube 11*p*, and the rod-shaped member 12*c* is supported at the distal end of a support member 13 provided so as to pass generally in the diameter direction through the side wall portion 1*b* of the lower casing 1.

The support member 13 supports the rod-shaped member 12*c* in such manner that the entire collision member 12 including the other end of the rod-shaped member 12*c* is separated from the bottom portion 1*a* of the lower casing 1 and the inside surface of the side wall portion 1*b*.

The collision surface 12*a* is disposed so as to face the swirl flow generated by the gas emission nozzle 11 and an emission port 11*a* itself of the gas emission nozzle 11. The collision surface 12*a* and the emission port 11*a* of the gas emission nozzle 11 are placed so as to face each other across a predetermined gap.

Hereinabove, the predetermined gap in the present invention is defined as a distance whereby a sufficient speed is maintained in order for the powder accelerated by the gas emission nozzle 11 to collide and be pulverized. The predetermined gap is preferably set to approximately 30 to 260 mm, although it differs depending on the inside diameter of the lower casing 1, the port diameter of the emission port 11*a*, and the emitted air quantity. The predetermined gap is preferably set to approximately 70 to 130 mm, in a case in which the inside diameter of the lower casing 1 is approximately 400 mm, the port diameter (the diameter) of the emission port 11*a* is approximately 8.6 mm, and the air quantity is approximately 5 $m^3$/min, for example.

Thus, the powder supplied from the raw material supply tube 5 into the pulverization chamber 10 is made to collide with the collision surface 12*a* by the emitted gas (jet airflow) from the gas emission nozzle 11, whereby the power can be finely pulverized.

Particularly, at least a part of the conical collision surface 12*a*, i.e. the region near the side wall portion 1*b* of the lower casing 1 is configured as a specific surface inclined toward the side wall portion 1*b* of the lower casing 1 relative to the diameter direction in association with the axis X, much of the powder reflected by this specific surface continuously collides with the side wall portion 1*b* of the lower casing 1, thereby being pulverized further.

In the center along the diameter of the classification chamber 6, more specifically between the flat top surface of the bottom plate 14 and the fine-powder discharge port 4*a* of the upper casing 2, there is provided a classification rotor 7 which is rotatably driven about the axis X. The classification rotor 7 has a generally cylindrical shape, the external peripheral surface of which is continuously connected with the circular truncated cone shaped classification chamber 6, and the top end of the classification rotor 7 is continuously connected with the fine-powder discharge port 4*a*.

The classification rotor 7 is attached to the top end of a rotating shaft 8 extending in a vertical direction from a space below the lower casing 1 to a space above the top surface 14*a* of the bottom plate 14, via through-holes formed in the centers of the bottom plate 14 and the lower casing 1. A pulley 9 is attached to the bottom end of the rotating shaft 8 to rotate the classification rotor 7 in the direction of the arrow shown in FIG. 2 by a motor (not shown). The rotational direction of the classification rotor 7 coincides with the orientation of the jet airflow from the gas emission nozzle 11.

The classification rotor 7 has a lower ring member 7*a* connected to the top end of the rotating shaft 8, an upper ring member 7*b* disposed to face the bottom surface of the periphery of the through-hole in the upper casing 2 forming the fine-powder discharge port 4*a*, and a plurality of classification blades 7*c* extending vertically so as to connect the lower ring member 7*a* and the upper ring member 7*b*. Each of the classification blades 7*c* has a long, thin, rectangular plate shape extending vertically, and the inside diameter of the upper ring member 7*b* is substantially the same as the inside diameter of the fine-powder discharge tube 4.

The lower ring member 7*c* comprises a circular truncated cone shaped base end portion connected to the top end of the rotating shaft 8, and a circular plate shaped portion extending in a radially outward direction from the bottom end of the base end portion, and the classification blades 7*c* are erected from the top surface of the circular plate shaped portion. The outside diameter of the circular plate shaped portion is substantially the same as the diameter of the top surface 14*a* of the bottom plate 14, and the circular plate shaped portion is disposed to face the top surface 14*a* of the bottom plate 14. The classification rotor 7 is supported on the rotating shaft 8 in a cantilever fashion via the lower ring member 7*a*, as shown in FIG. 1.

The shape and number of the classification blades 7*c* are not limited to the example shown in FIGS. 1 and 2, and can be selected as desired. The shape of the classification blades 7*c* can be selected from a flat plate shape, a wedge shape that is thick in the external peripheral side and thin in the inner side, a teardrop shape having a curved surface in the external peripheral side, a curved flat plate, a flat plate with a bent distal end, and, a shape such that the upper outside diameter of the classification rotor 7 is greater than the lower outside diameter, or the like.

The classification blades 7*c* are disposed in a radial formation from the center of the classification rotor 7 along the external peripheral surface, but may also be disposed slanted to the opposite direction of the rotational direction relative to the center. It is configured such that, when the upper casing 2 being attached, a small gap is formed but there is no contact between the bottom surface of the periphery of the through-hole in the upper casing 2 and the top end surface of the upper ring member 7*b* of the classification rotor 7.

In the inside surface of the upper casing 2 facing the upper ring member 7*b* of the classification rotor 7, two annular grooves are provided so as to be separated from each other in the radial direction. A labyrinth seal is thereby created in the gap between the upper casing 2 and the classification rotor 7, and the coarse powder is prevented from getting out from the classification chamber 6 into the fine-powder discharge tube 4. Furthermore, by supplying a compressed gas into the gap so that the pressure in the gap exceeds that of the interior of the classification chamber 6, whereby coarse powder can be more effectively prevented from getting out.

In the same manner, the configuration is such that a small gap to prohibit a contact is formed with between the lower ring member 7*a* and the top surface 14*a* of the bottom plate 14.

The powder supplied from the raw material supply tube 5 is accelerated by the gas emitted from the gas emission nozzle 11, and is pulverized by colliding with the collision member 12 or the internal peripheral wall surface of the lower casing 1, or by collisions with itself. It is configured such that the powder repeatedly collides with the collision member 12 and with itself while swirling at high speeds around the conical internal peripheral surface of the upper casing 2, and pulverization of the powder proceeds.

The fine powder that has been made into a fine powder by the pulverization process is transferred from the pulverization chamber 10 to the classification chamber 6, while swirling at high speeds along the internal peripheral surface. Inside the classification chamber 6, fine powder that has been sufficiently made into a fine powder is classified by the classification rotor 7, passed through the interior of the classification rotor 7 to be expelled out of the apparatus through the fine-powder discharge tube 4, and recovered by a cyclone, a dust collector, or another known collecting means. On the other hand, coarse powder larger than a predetermined grain size is not passed through the classification rotor 7, but is carried to the lower side of the classification rotor 7 and returned to the pulverization chamber 10 to be pulverized again.

It is possible to set the size and inclination angle and so on of the bottom end of the bottom plate 14 as desired. For example, when the inside diameter of the lower casing 1 is approximately 400 mm and the height of the internal peripheral surface is approximately 75 mm, it is possible to set, the outside diameter of the top end of the bottom plate 14 as approximately 170 mm, the outside diameter of the bottom end as approximately 300 mm, the inclination angle of the same as approximately 50 degrees, and the height of the same as approximately 75 mm. Although it may be configured such that the outside diameter of the bottom end of the bottom plate 14 is greater than the outside diameter of the top end to form an inclined surface, it is preferable to set said outside diameter as at least one-half of the inside diameter of the lower casing 1, in terms of further reducing the amount of stagnant powder.

Though not shown, the fine-powder discharge port 4*a* may be provided in the top surface of the bottom plate 14, and the fine-powder discharge tube 4 may be passed through the middle of the bottom plate 14 and drawn out below the lower casing 1. In this case, the classification rotor 7, the rotating shaft 8, and the pulley 9 are supported on the upper side of the upper casing 2.

In the present embodiment, the number of gas emission nozzles 11 attached to the lower casing 1 is not limited to one, and it may be a plurality. The inside diameter of the emission port 11*a* can also be varied as appropriate according to the type, the properties, the grain size, or the intended grain size of powder. Depending on the type of powder, the collision member 12 may not be provided, and the powder would be finely pulverized by swirling at high speeds inside the pulverization chamber 10 and thereby colliding with itself or colliding with the internal peripheral wall surface of the lower casing 1.

The shape of the collision surface 12*a* of the collision member 12 is not limited to a conical shape, and it may be a pyramid or a spherical shape. The base portion 12*b* may be a polygonal pillar or a sphere instead of a circular pillar. When a circular pillar or a polygonal pillar is used as the shape of the base portion 12*b*, the collision surface 12*a* is preferably configured from a surface inclined toward the side wall portion 1*b* of the lower casing 1 in relation to the diameter direction associated with the axis X, so that the powder rebounds toward the internal peripheral surface of the lower casing 1 after having collided with the collision surface 12*a*.

The material of the collision surface 12*a* of the collision member 12 is preferably made from a super hard alloy or a ceramic in view of preventing damage from abrasion, but depending on the type of powder, the material is not necessarily limited to these examples. It is possible to use aluminum oxide, zirconium oxide, tungsten carbide, silicon carbide, titanium carbide, silicon nitride, titanium nitride and so on, but without limitation, as the preferred examples of the super hard alloy or ceramic.

When a heat-sensitive raw material is pulverized, it is also possible to cool the collision member 12. As a method of cooling, it is conceivable to let refrigerant flow through a refrigerant flow channel provided inside the collision member.

The pulverizing force can also be adjusted by varying the gap between the gas emission nozzle 11 and the collision member 12 as appropriate. Specifically, the configurations of these members can be varied as appropriate according to the type of powder, the properties, the grain size, or the intended grain size. For this purpose, the means for connecting the support member 13 and the rod-shaped member 12*c* is configured to be capable of adjusting the gap between the collision surface 12*a* and the emission port 11*a*.

The materials for the lower casing 1, the upper casing 2, the fine-powder discharge tube 4, the classification rotor 7, the gas emission nozzle 11, the bottom plate 14, and other components are not particularly limited; these components may be created from a common material such as stainless steel. In the case of powder that has a high abrasive effect, at least components that powder contacts, including the gas emission nozzle 11 and the collision member 12, are preferably made from a super hard alloy or a ceramic material. It is possible to use aluminum oxide, zirconium oxide, tungsten carbide, silicon carbide, titanium carbide, silicon nitride, titanium nitride and so on, but without limitation, as the preferred examples of the super hard alloy or ceramic.

Second Embodiment

The second embodiment of the present invention will be described hereunder based on FIG. 3.

In the second embodiment, essentially, the pulverization chamber 10 and the classification chamber 6 in the jet mill in the embodiment described using FIGS. 1 and 2 are oriented laterally, and the gas emission nozzle 11, classification rotor 7, and other configurational members of these chambers are attached accordingly.

The term "oriented laterally" means to being disposed so that the rotational axis direction and gravitational axis direction of the classification rotor 7 are substantially orthogonal to each other.

Namely, the essential structure is the same as the first embodiment shown in FIGS. 1 and 2, but in the case of a lateral orientation, it is preferable that the raw material supply tube 5 should be attached to the external peripheral wall surface of the lower casing 1 constituting the pulverization chamber 10, the raw material supply tube 5 to be displaced to a side from the center of the lower casing 1 and disposed along the rotational direction of the classification rotor 7 so as to be connected with the pulverization chamber 10.

In the second embodiment, since the pulverization chamber 10 and the classification chamber 6 are oriented laterally, the powder stagnates more easily in the lower part of the lower casing 1 due to gravity. Therefore, the gas emission nozzle 11 and the collision member 12 are disposed in the vertically lower part of the lower casing 1 with a substantially horizontal orientation. Thereby, a pulverizing effect can be imparted to the powder by the gas emission nozzle 11 and the collision member 12, under the condition in which the concentration of powder is high in a limited space, the powder can be pulverized effectively.

Embodied Example

Figure 3:
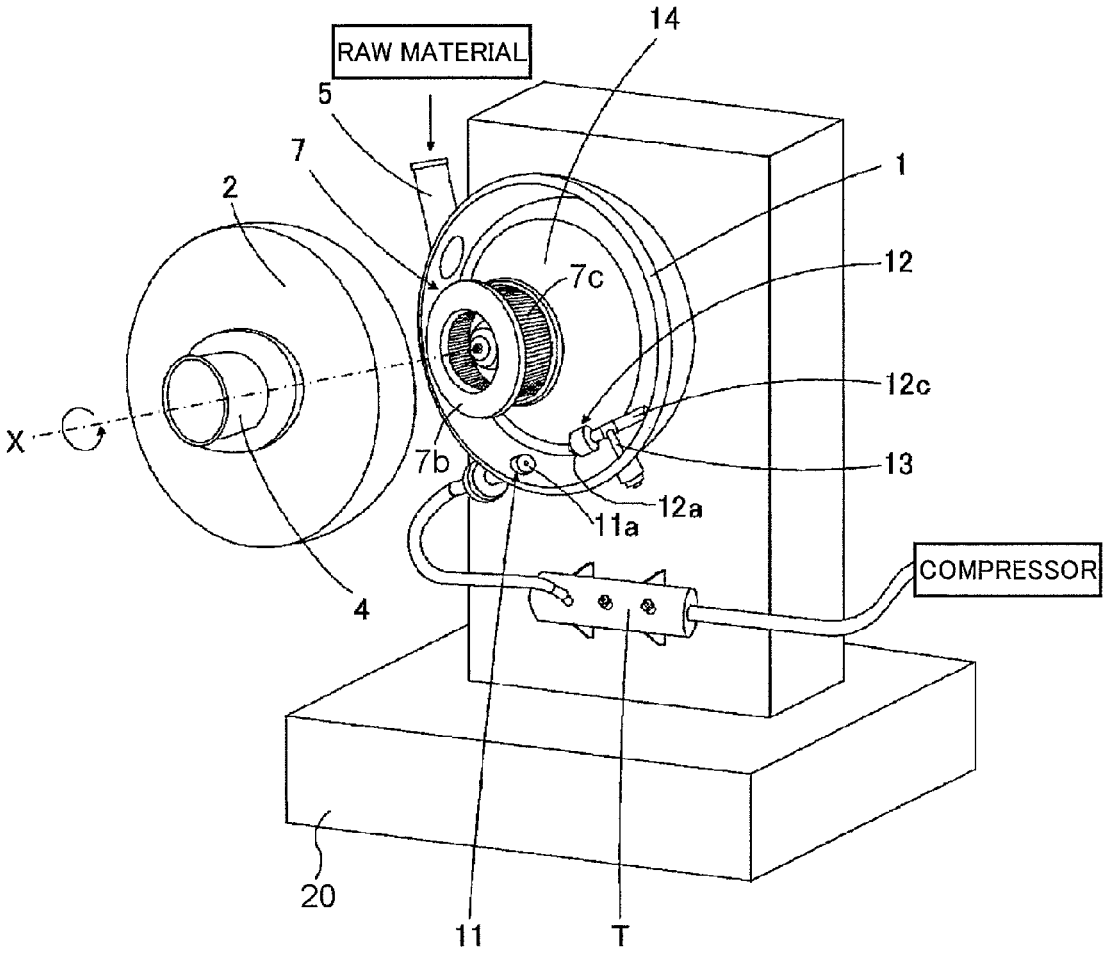
FIG. 3 is a perspective view showing another embodiment of the jet mill of the present invention.
Figure 4:
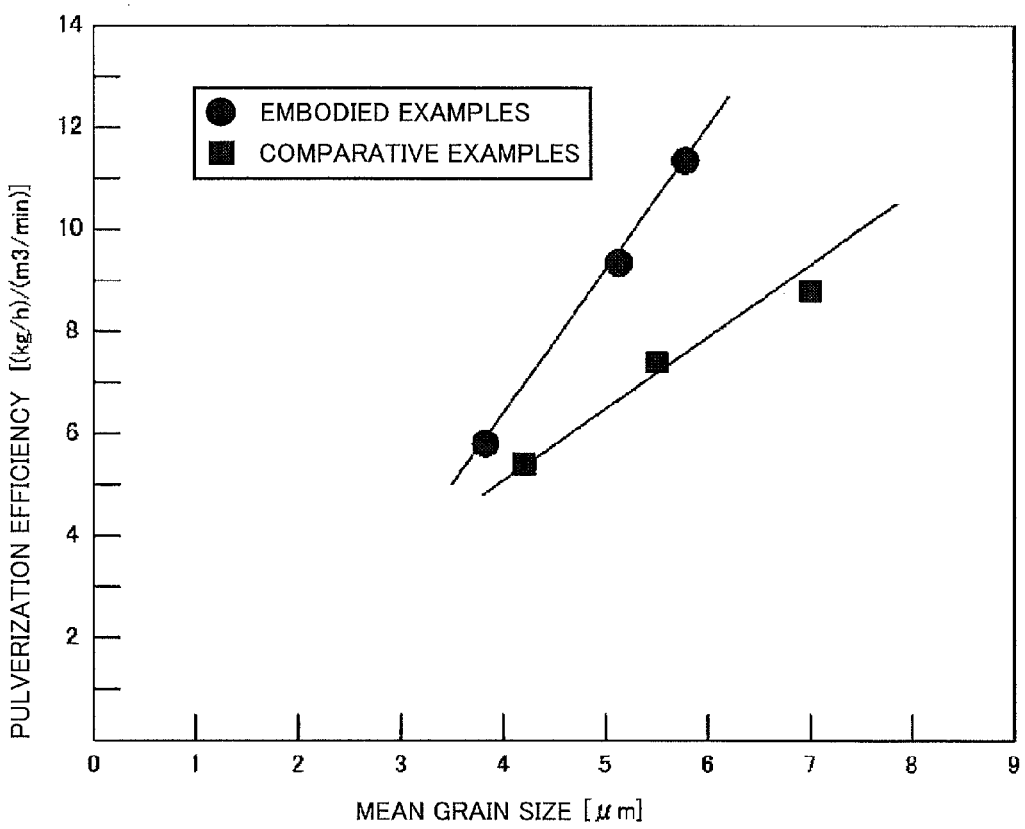
FIG. 4 is a graph showing performance of working examples of the jet mill of the present invention and comparative examples.
Figure 5:
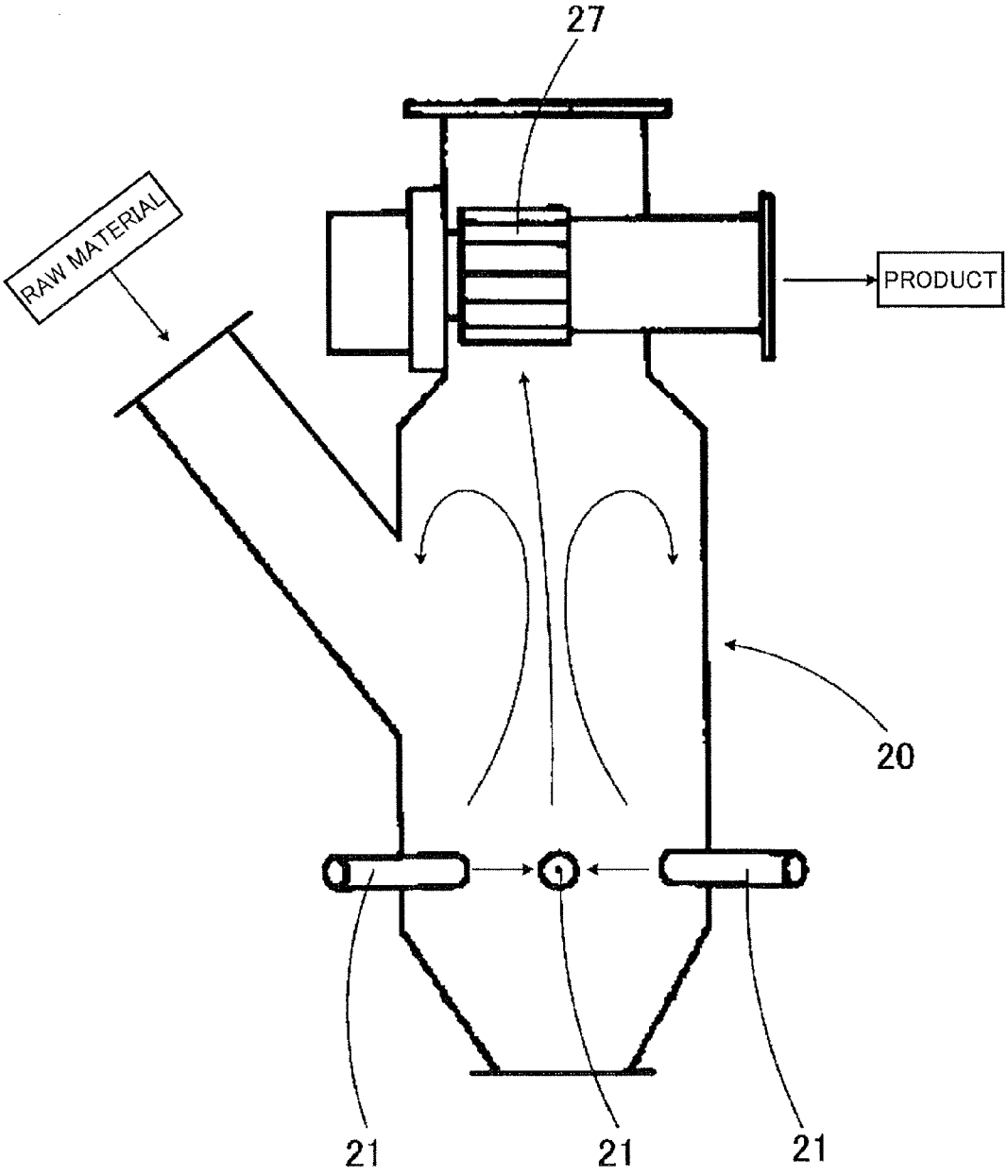
FIG. 5 is a schematic drawing of a jet mill used as a comparative example in a working example of the present invention.

As an embodied example, a pulverization test was conducted using the laterally oriented jet mill of the second embodiment shown in FIG. 3. As a comparative example, a pulverization test was conducted using the fluidized bed type jet mill (Counter Jet Mill 200 AFG (Hosokawa Micron Group)) shown in FIG. 5. FIG. 4 shows the results of these pulverization tests.

In these both pulverization tests, heavy calcium carbonate having a mean grain size of 235 μm was used as the object to be processed. The operation was performed with adjusting the rotational speeds of both classification rotors 7, 27 in such way that the mean grain sizes of the products obtained by the two pulverization become equal, and the pulverization efficiencies at this time were compared. The masses of powder remained inside the apparatus after the operation had ended were also weighed and compared.

FIG. 4 is a graph in which the horizontal axis is the mean grain size [μm] of the powder obtained by pulverization, and the vertical axis is the processing ability per unit air quantity, i.e. the pulverization efficiency ((kg/h)/($m^3$/min)).

As shown in FIG. 4, although there is no great difference in the mean grain sizes of the resulting powders between the embodied examples and the comparative examples, it is clear that the embodied examples had better pulverization efficiency than the comparative examples. In other words, to obtain the products with the same mean grain size, it is clear that the working examples show a greater energy conservation effect than the comparative examples. The amount of stagnant powder in the apparatus remained after the operation had ended was 2 kg in the embodied examples which is far less than 17 kg in the case of comparative examples, and the amount of raw material wasted was successfully reduced.

INDUSTRIAL APPLICABILITY

The present invention is an apparatus that can finely pulverize various materials efficiently in a wide range of fields, typical examples including: inorganic compounds such as: lithium compounds including lithium carbonate, lithium hydroxide, lithium nicolate, lithium cobalt oxide, and lithium manganite, etc.; sodium compounds including sodium nitrate (sodium sulfate), sodium hydroxide, sodium carbonate, sodium bicarbonate, sodium sulfite, sodium nitrite, sodium sulfide, sodium silicate, sodium nitrate, sodium bisulfate, sodium thiosulfate, and sodium chloride, etc.; magnesium compounds including magnesium sulfate, magnesium chloride, magnesium hydroxide, magnesium oxide, magnesium carbonate, magnesium acetate, magnesium nitrate, magnesium oxide, and magnesium hydroxide, etc.; aluminum compounds including aluminum hydroxide, aluminum sulfate, aluminum hydroxide, poly aluminum chloride, aluminum oxide, alum, aluminum chloride, aluminum nitride, etc.; silicon compounds including silicon oxide, silicon nitride, silicon carbide, calcium silicate, magnesium silicate, sodium silicate, aluminum silicate, etc.; potassium compounds including potassium chloride, potassium hydroxide, potassium sulfate, potassium nitrate, potassium carbonate; calcium compounds including calcium carbonate, calcium chloride, calcium sulfate, calcium nitrate, calcium hydroxide, etc.; titanium compounds including titanium oxide, barium titanate, strontium titanate, titanium carbide, titanium nitride, etc.; manganese compounds including manganese sulfate, manganese carbonate, manganese oxide, etc.; iron compounds including iron oxide etc.; cobalt compounds including cobalt chloride, cobalt carbonate, cobalt oxide, etc.; nickel compounds including nickel hydroxide, nickel oxide, etc.; yttrium compounds including yttrium oxide, yttrium iron garnet, etc.; zirconium compounds including zirconium hydroxide, zirconium oxide, zirconia silicate, zircon sand, etc.; antimony compounds including antimony chloride, antimony oxide, antimony sulfate, etc.; barium compounds including barium chloride, barium oxide, barium nitrate, barium hydroxide, barium carbonate, barium sulfate, barium titanate, etc.; bismuth compounds including bismuth oxide, bismuth subcarbonate, bismuth hydroxide, etc.; magnetic materials including alnico magnets, iron-chrome-cobalt magnets, iron-manganese magnets, barium magnets, strontium magnets, samarium-cobalt magnets, neodymium-iron-boron magnets, manganese-aluminum-carbon magnets, praseodymium magnets, and platinum magnets; as well as pigments, glass, metal oxides, carbon, active carbon, coke, minerals, talc, battery materials, hydrogen storage alloys, organic compounds, resins, toners, powder paints, and the like. Because the amount of stagnant powder in the apparatus and the remained amount after the apparatus has stopped are both small, the amount of raw material wasted can be reduced either.

EXPLANATIONS OF LETTERS OR NUMERALS

1 Lower casing
2 Upper casing
3 Fastening tool
4 Fine-powder discharge tube
4*a* Fine-powder discharge port
5 Raw material supply tube (raw material supply port)
6 Classification chamber
7 Classification rotor
7*c* Classification blades
8 Rotating shaft
9 Pulley
10 Pulverization chamber
11 Gas emission nozzle
11*a* Emission port
12 Collision member
12*a* Collision surface
12*b* Base portion
12*c* Rod-shaped member
13 Support member
14 Bottom plate (circular truncated cone shaped adapter)
20 Container
21 Gas emission nozzle
27 Classification rotor
X axis
T Gas storage tank

The invention claimed is:

1. A jet mill comprising:

a lower casing having an external peripheral surface and a cylindrical internal peripheral surface;

an upper casing having a conical internal peripheral surface; and an adapter plate provided at a center of a bottom portion of the lower casing, the adapter plate having a horizontally-oriented flat top surface and a side surface which is inclined from an external periphery of the top surface toward the bottom portion of the lower casing, wherein a space defined by the conical internal peripheral surface of the upper casing and the inclined side surface of the adapter plate forms a lower cylindrical pulverization chamber and an upper classification chamber connected with the pulverization chamber, wherein the classification chamber is provided with a classification rotor connected with a fine-powder discharge port, the conical internal peripheral surface of the upper casing extending from the cylindrical internal peripheral surface of the lower casing and being inclined toward the classification rotor along an axis of the classification rotor, and wherein the pulverization chamber is provided with a raw material supply port and at least one gas emission nozzle disposed slanted in a rotational direction of the classification rotor from an external peripheral wall surface, the raw material supply port having an open end formed where the conical internal peripheral surface of the upper casing meets the cylindrical internal peripheral surface of the lower casing to supply raw material powder to the pulverization chamber.

2. The jet mill according to claim 1, wherein the mill is provided with a collision member facing a distal end of the gas emission nozzle across a predetermined gap.

3. The jet mill according to claim 2, wherein a collision surface of the collision member is inclined relative to the gas emission nozzle toward an internal peripheral surface of a casing of the pulverization chamber.

4. The jet mill according to claim 2, wherein the collision surface of the collision member is configured as a cone, a pyramid, or an obliquely truncated circular or polygonal pillar.

5. The jet mill according to claim 1, wherein the pulverization chamber and the classification chamber are integrated together and oriented laterally.

6. The jet mill according to claim 5, wherein the gas emission nozzle is oriented substantially horizontally at a position at a bottom of the pulverization chamber.

* * * * *